US010097926B2

(12) United States Patent
Pircaro

(10) Patent No.: US 10,097,926 B2
(45) Date of Patent: Oct. 9, 2018

(54) VOICE COIL BOBBIN FOR AN ELECTROACOUSTIC TRANSDUCER

(71) Applicant: Bose Corporation, Framingham, MA (US)

(72) Inventor: Mark A. Pircaro, Yuma, AZ (US)

(73) Assignee: Bose Corporation, Framingham, MA (US)

( * ) Notice: Subject to any disclaimer, the term of this patent is extended or adjusted under 35 U.S.C. 154(b) by 88 days.

(21) Appl. No.: 14/959,517

(22) Filed: Dec. 4, 2015

(65) Prior Publication Data

US 2017/0164113 A1 Jun. 8, 2017

(51) Int. Cl.
*H04R 9/04* (2006.01)
*H04R 7/18* (2006.01)

(52) U.S. Cl.
CPC ..... *H04R 9/045* (2013.01); *H04R 7/18* (2013.01); *H04R 9/046* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,767,837 | A | 6/1930 | Davis et al. | |
| 1,869,230 | A | 7/1932 | Timmons | |
| 2,004,735 | A | 6/1935 | Thomas | |
| 2,699,472 | A | 1/1955 | Olson et al. | |
| 3,792,394 | A | 2/1974 | Bertagni | |
| 4,188,711 | A | 2/1980 | Babb | |
| 4,591,667 | A | 5/1986 | Hino et al. | |
| 5,717,775 | A | 2/1998 | Sakamoto et al. | |
| 7,177,439 | B2 * | 2/2007 | Tardo | H04R 9/022 381/397 |
| 7,185,735 | B2 * | 3/2007 | Sahyoun | H04R 7/122 181/147 |
| 2005/0281432 | A1 * | 12/2005 | Horigome | H04R 9/027 381/412 |
| 2008/0056528 | A1 * | 3/2008 | Yano | H04R 9/025 381/420 |

(Continued)

FOREIGN PATENT DOCUMENTS

| | | |
|---|---|---|
| EP | 0610769 A2 | 8/1994 |
| GB | 461073 A | 2/1937 |

(Continued)

OTHER PUBLICATIONS

International Search Report and Written Opinion for International application No. PCT/US2016/064310 dated Mar. 1, 2017.

*Primary Examiner* — Amir Etesam
(74) *Attorney, Agent, or Firm* — Brian M. Dingman; Dingman IP Law, PC

(57) ABSTRACT

An apparatus includes a voice coil bobbin for an electroacoustic driver. The bobbin has a plurality of cutouts for venting an interior of the bobbin. The bobbin includes a plurality of integral flanges at the end of the bobbin which can be used to secure a diaphragm to the end of the bobbin. Each of the flanges extends from the bobbin at an angle that is no more than about thirty nine degrees relative to a plane that is substantially perpendicular to an intended direction of travel of the bobbin during operation of the driver. An electrically conductive voice coil is wound around the bobbin.

11 Claims, 2 Drawing Sheets

(56) References Cited

U.S. PATENT DOCUMENTS

2014/0321690 A1* 10/2014 Reining ..... H04R 9/02
381/396

FOREIGN PATENT DOCUMENTS

| | | | |
|---|---|---|---|
| JP | S6068796 | U | 5/1985 |
| JP | 2003135492 | A | 5/2003 |
| WO | 2015129232 | A1 | 9/2015 |

* cited by examiner

VOICE COIL BOBBIN FOR AN ELECTROACOUSTIC TRANSDUCER

BACKGROUND

U.S. Pat. No. 4,591,667 (the '667 patent) discloses structure for a dome speaker that includes a dome-shaped diaphragm formed of a high rigidity material and having an outer periphery, a voice coil bobbin secured at a top end thereof to the outer periphery of the diaphragm, a voice coil mounted about the bobbin, and a variation means in the bobbin for varying the resonance conditions of the diaphragm. The variation means includes at least one cut-out portion provided at the top end of the bobbin and a sheet which closes the cut-out portion. Preferably, the diaphragm is made of a nitrified titanium alloy and the sheet is made from a material softer than the bobbin. The cut-out portion may have a width from about 7 to about 50 percent of the total circumferential length of the bobbin.

The '667 patent does not disclose having the voice coil 1 covering up any portion of any of the cut-out portions 2. As such, a dimension of the voice coil bobbin 1a in an intended direction of travel of the bobbin during operation of the speaker is greater than necessary.

U.S. Pat. No. 1,767,837 (particularly FIG. 7) discloses a speaker with a coil form 25 that includes a collar portion 46. The collar portion 46 has a flanged extension 43 which appears to be oriented at roughly a forty five degree angle relative to an intended direction of travel of the coil form 25 during operation of the speaker. Having the flanged extension 43 at such an angle causes a dimension of the coil form 25 in an intended direction of travel of the coil form 25 during operation of the speaker to be greater than necessary.

SUMMARY

In one aspect, an apparatus includes a voice coil bobbin for an electroacoustic driver. The bobbin has a plurality of cutouts for venting an interior of the bobbin. The bobbin includes a plurality of integral flanges at the end of the bobbin which can be used to secure a diaphragm to the end of the bobbin. Each of the flanges extends from the bobbin at an angle that is no more than about thirty nine degrees relative to a plane that is substantially perpendicular to an intended direction of travel of the bobbin during operation of the driver. An electrically conductive voice coil is wound around the bobbin.

Implementations may include one of the following features, or any combination thereof. Each cutout is open at an end of the bobbin where the flanges are located. Each cutout has a first side that extends in a substantially circumferential first direction about the bobbin. Each cutout has second and third sides which each extend in a second direction that is substantially perpendicular to the first direction. The first side is longer than each of the second and third sides. An end of the voice coil is connected to an end of an electrical conductor that provides electrical power to the voice coil. The ends of the voice coil and conductor are secured to an outside of the voice coil. Each of the cutouts is substantially round, square, rectangular, triangular or pentagonal in shape.

In another aspect, an apparatus includes a voice coil bobbin for an electroacoustic driver. The bobbin has a plurality of cutouts for venting an interior of the bobbin. An electrically conductive voice coil is wound around the bobbin. The voice coil partially covers up the cutouts in the bobbin.

Implementations may include one of the above and/or below features, or any combination thereof.

Each cutout is open at an end of the bobbin to which a diaphragm will be secured for creating sound waves According to a further aspect, an apparatus includes a voice coil bobbin for an electroacoustic driver. The bobbin includes a plurality of integral flanges at an end of the bobbin. The flanges are used to secure a diaphragm to the end of the bobbin. Each of the flanges extends from the bobbin at an angle that is no more than about thirty nine degrees relative to a plane that is substantially perpendicular to an intended direction of travel of the bobbin during operation of the driver.

Implementations may include one of the above and/or below features, or any combination thereof.

Each cutout is open at the end of the bobbin.

All examples and features mentioned above can be combined in any technically possible way. Other features and advantages will be apparent from the description and the claims.

DESCRIPTION

The discussion below discloses a voice coil bobbin for an electro-acoustic driver. The geometry of the bobbin allows it to be compact in a dimension of an intended direction of travel of the bobbin during operation of the driver. This compactness of the bobbin allows the driver, and a speaker in which the driver is located, to thus be more compact.

Figure 1:
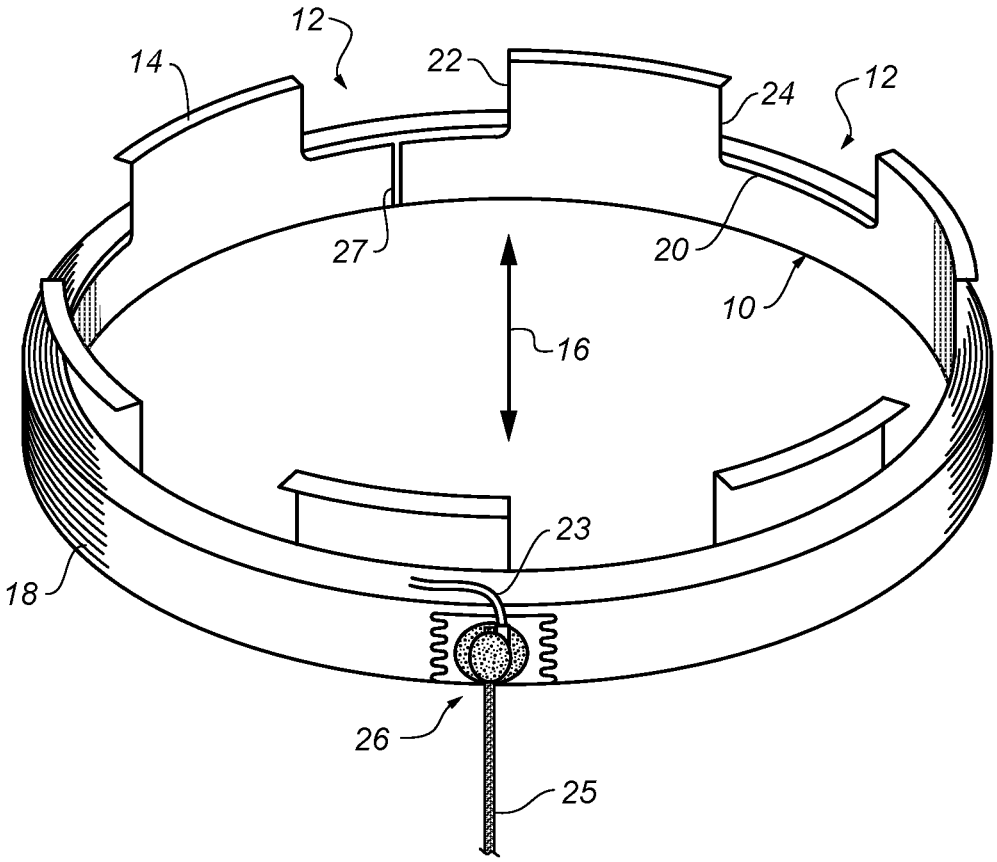
FIG. 1 shows a perspective view of a voice coil bobbin with a voice coil wrapped around the bobbin.

Referring to FIG. 1, a voice coil bobbin 10 for an electroacoustic driver includes a plurality of cutouts 12 for venting an interior of the bobbin. The bobbin 10 also has a plurality of integral flanges 14 at the end of the bobbin. The flanges 14 are used to secure a diaphragm (not shown) to the end of the bobbin 10 with, for example, adhesive). Each of the flanges 14 extends from the bobbin 10 at an angle that is preferably no more than about twelve degrees relative to a plane that is substantially perpendicular to an intended direction of travel 16 of the bobbin during operation of the driver. Although the bobbin 10 in this example is substantially round in shape (when viewed along the direction of travel 16), the bobbin can have other shapes such as square, ovoid, oblong, and rectangular.

An electrically conductive voice coil 18 is wound around the bobbin 10. The voice coil 18 is a multiplicity of wraps of an insulated wire. The voice coil 18 in this example partially covers up the cutouts 12 in the bobbin 10 (in another example the voice coil 18 may not cover up the cutouts at all). Each cutout 12 in this example is open at an end of the bobbin 10 where the flanges 14 are located. Each cutout 12 has a first side 20 that extends in a substantially circumferential first direction about the bobbin 10. Each cutout 12 has second and third sides 22, 24 which each extend in a second direction that is substantially perpendicular to the first direction. In this example the first side 20 is longer than each of the second and third sides 22, 24.

An end 23 of the voice coil 18 (called a voice coil lead out) is connected to an end of an electrical conductor 25

(known as tinsel wire) that provides electrical power to the voice coil. The ends of the voice coil 18 and conductor 25 are secured to an outside of the voice coil 18 at a location 26. Another voice coil lead out and conductor (not shown) are connected and secured to an outside of the voice coil on an opposite side of the bobbin 10. The bobbin 10 is preferably made of aluminum. A slit 27 is provided in the bobbin 10 primarily so that the ends of the bobbin at the slit do not overlap and come in contact with each other given manufacturing tolerances. In addition, this arrangement reduces or prevents circumferential continuous eddy currents in the bobbin 10.

Figure 2A:
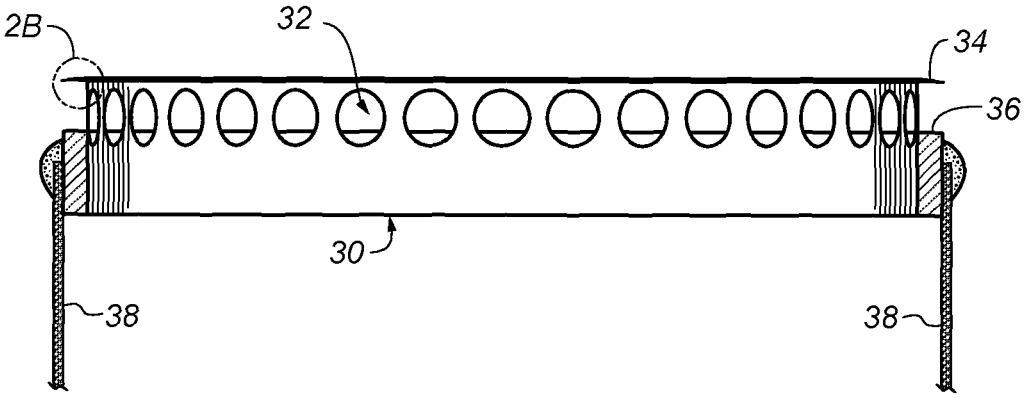
FIG. 2A is a sectional view of another example of a voice coil bobbin with a voice coil wrapped around the bobbin.

Turning to FIG. 2A, another example of a voice coil bobbin 30 is shown in which each of a series of cutouts 32 is substantially round in shape. In other examples, these cutouts could have other shapes such as square, rectangular, triangular, pentagonal, etc. Each cutout 32 in this example is not open at an end of the bobbin 30 where the flanges 34 are located. A voice coil 36 is wound around the bobbin 30. The voice coil 36 in this example partially covers up the cutouts 32 in the bobbin 30. Again, in other examples, the voice coil may not cover up the cutouts at all. A pair of conductive tinsel wire 38 is connected to respective voice coil lead outs (not shown) on opposite sides of the bobbin 30 and respectively secured to an outside of the voice coil.

Figure 2B:
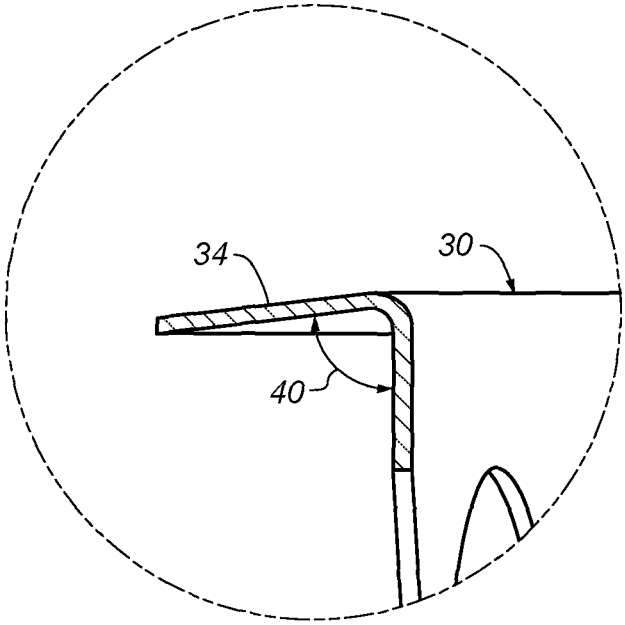
FIG. 2B shows detail of a portion of FIG. 2A.

With reference to FIG. 2B, the geometry of the flange 34 relative to a main portion of the bobbin 30 is shown. An angle 40 of the flange 34 relative to a main portion of the bobbin 30 is about 83 degrees in this example. Another way of stating this is that the flange 34 extends from the bobbin 30 at an angle of about 7 degrees relative to a plane that is substantially perpendicular to an intended direction of travel of the bobbin during operation of the driver (see FIG. 1). This angle is preferable no more than about 12 degrees, more preferably no more than about 25 degrees, and even more preferable no more than about 39 degrees, and can be below or above the plane just described.

Several implementations have been described. Nevertheless, it will be understood that additional modifications may be made without departing from the scope of the inventive concepts described herein, and, accordingly, other embodiments are within the scope of the following claims.

What is claimed is:

1. An apparatus, comprising: a voice coil bobbin for an electroacoustic driver, the bobbin having a plurality of cutouts for venting an interior of the bobbin, the bobbin including a plurality of integral flanges at the end of the bobbin, the flanges being used to secure a diaphragm to the end of the bobbin, each of the flanges extending from the bobbin at an angle that is no more than about thirty nine degrees relative to a plane that is substantially perpendicular to an intended direction of travel of the bobbin during operation of the driver; and an electrically conductive voice coil that is in contact with the bobbin, wherein an end of the voice coil is connected to an end of an electrical conductor that provides electrical power to the voice coil, the ends of the voice coil and conductor being secured to an outside of the voice coil; and the voice coil only partially covering up the cutouts in the bobbin.

2. The apparatus of claim 1, wherein each cutout is open at an end of the bobbin where the flanges are located.

3. The apparatus of claim 1, wherein each cutout has a first side that extends in a substantially circumferential first direction about the bobbin.

4. The apparatus of claim 3, wherein each cutout has second and third sides which each extend in a second direction that is substantially perpendicular to the first direction.

5. The apparatus of claim 4, wherein the first side is longer than each of the second and third sides.

6. The apparatus of claim 1, wherein each of the cutouts is substantially round, square, rectangular, triangular or pentagonal in shape.

7. An apparatus, comprising:

a voice coil bobbin for an electroacoustic driver, the bobbin including a plurality of integral flanges at an end of the bobbin, the flanges being used to secure a diaphragm to the end of the bobbin, each of the flanges extending from the bobbin at an angle that is no more than about thirty nine degrees relative to a plane that is substantially perpendicular to an intended direction of travel of the bobbin during operation of the driver; and an electrically conductive voice coil that is in contact with the bobbin, wherein the bobbin has a plurality of cutouts for venting an interior of the bobbin, and wherein the voice coil only partially covering up the cutouts in the bobbin.

8. The apparatus of claim 7, wherein each cutout is open at the end of the bobbin.

9. The apparatus of claim 7, wherein each cutout has a first side that extends in a substantially circumferential first direction about the bobbin.

10. The apparatus of claim 9, wherein each cutout has second and third sides which each extend in a second direction that is substantially perpendicular to the first direction.

11. The apparatus of claim 10, wherein the first side is longer than each of the second and third sides.

* * * * *